US005191825A

United States Patent [19]

Beneteau et al.

[11] Patent Number: 5,191,825

[45] Date of Patent: Mar. 9, 1993

[54] LOW-IMPACT AIR CYLINDER

[75] Inventors: David M. Beneteau, Amherstburg; Mark J. Dolata, Windsor, both of Canada

[73] Assignee: Doben Limited, Windsor, Canada

[21] Appl. No.: 897,438

[22] Filed: Jun. 12, 1992

[51] Int. Cl.[5] ..... F01B 7/20; F01B 7/00

[52] U.S. Cl. ..... 91/173; 91/189 A; 92/62; 92/65; 92/110; 92/151; 92/152

[58] Field of Search ..... 92/61, 62, 65, 110, 92/150, 151, 152; 91/170 R, 178, 181, 182, 183, 184, 189 R, 189 A, 173, 174

[56] References Cited

U.S. PATENT DOCUMENTS

| | | | |
|---|---|---|---|
| 3,253,519 | 5/1966 | De Roo | 92/151 |
| 3,353,352 | 11/1967 | Gardner | 92/110 |
| 3,485,141 | 12/1969 | Ott et al. | 92/151 |
| 3,499,369 | 3/1970 | Joseph | 92/65 |
| 3,968,735 | 7/1976 | Boisde et al. | 92/151 |
| 4,258,609 | 3/1981 | Conway | 92/110 |
| 4,296,679 | 10/1981 | Mattsson | 92/65 |
| 4,593,606 | 6/1986 | Klatt et al. | 92/65 |

FOREIGN PATENT DOCUMENTS

| | | | |
|---|---|---|---|
| 1964076 | 6/1971 | Fed. Rep. of Germany | 91/173 |
| 2336066 | 2/1975 | Fed. Rep. of Germany | 91/173 |
| 2444827 | 8/1980 | France | 91/173 |
| 0109805 | 8/1980 | Japan | 92/151 |
| 0729387 | 5/1980 | U.S.S.R. | 91/173 |
| 1029636 | 5/1966 | United Kingdom | 92/151 |

*Primary Examiner*—Thomas E. Denion
*Attorney, Agent, or Firm*—Allen D. Gutchess, Jr.

[57] ABSTRACT

A low-impact drive unit operates by air under pressure. It includes aligned working and pressure chambers. The working chamber contains a working piston and a working piston rod extending from an end of the chamber. The pressure chamber contains a rear outer piston having a cylindrical recess and a central bore. An inner piston is located in the cylindrical recess and has a main piston rod extending through the bore, a bore in a separator separating the chambers, and is affixed to the working piston, so as to move together. The main rod has a longitudinal passage which supplies air from the pressure chamber to the back of the working piston under certain conditions. After the working piston rod contacts a workpiece, force of air pressure on all three pistons act on the working piston rod. An air return passage is provided to return the various components to their initial position after the working operation is complete.

19 Claims, 1 Drawing Sheet

LOW-IMPACT AIR CYLINDER

This invention relates to a low-impact drive unit powered by gas under pressure.

The low-impact drive unit according to the invention operates by gas, usually air, under pressure. The new drive unit includes a cylinder which is divided by a plug or separator into two chambers—a working chamber and a pressure chamber. The working chamber contains a working piston and a working piston rod extending from an end of the cylinder. The pressure chamber contains a rear outer piston having a cylindrical recess and a central bore. An inner piston is located in the cylindrical recess and has a main piston rod extending through the bore, through a bore in the separator, and is affixed through the working piston to the working piston rod so as to move together. When air is supplied to the rear of the pressure chamber, the inner piston is moved to the end of the recess and the inner and outer rear pistons then move together toward the working chamber. When the working piston rod reaches the workpiece, the outer rear piston then moves further forward with air then being supplied through the main rod passage to the working chamber behind the working piston. At this point, the air in the pressure and working chambers produces the full force of all three pistons on the working piston rod. An air return passage is provided to return the various components to their initial position after the working operation is complete.

It is, therefore, a principal object of the invention to provide a low-impact drive unit which operates by gas under pressure, and uses less volume of air to produce the same force as a regular dual piston cylinder.

Many other objects and advantages of the invention will be apparent from the following detailed description of a preferred embodiment thereof, reference being made to the accompanying drawings, in which.

Figure 1:
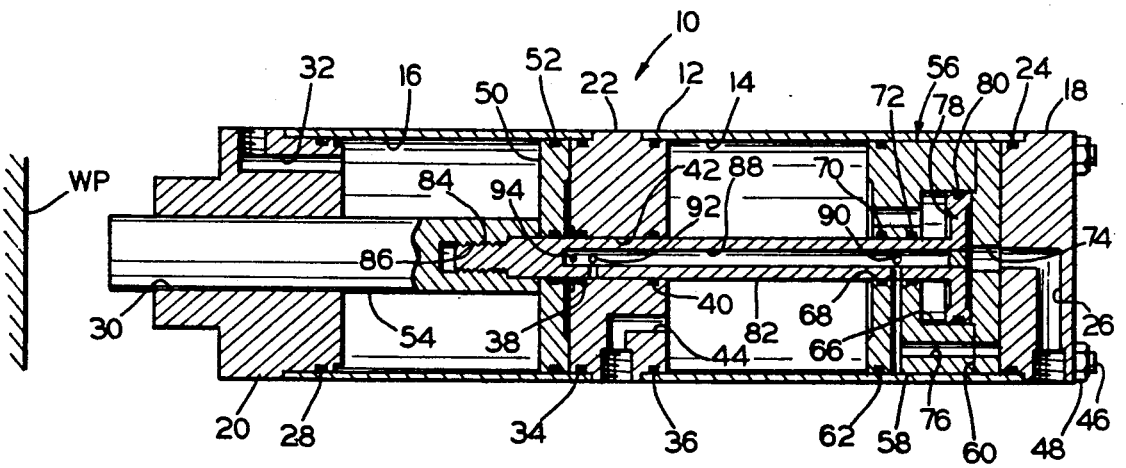
FIG. 1 is a somewhat schematic view in longitudinal cross section of a low-impact drive unit in accordance with the invention.

A low-impact drive unit in accordance with the invention is indicated at 10 and includes wall means forming a two-piece cylinder 12 which has a first or pressure cylindrical chamber 14 and a second or working cylindrical chamber 16. The first end of the cylinder 12 has a first end plug or block 18 closing off an end of the chamber 14. The other end of the cylinder 12 has a second end plug or block 20 closing off the end of the chamber 16. An intermediate fixed plug or separator 22 constitutes a divider or partition separating the chambers 14 and 16. The end plug 18 has an annular seal 24 and an L-shaped passage 26 which communicates with the chamber 14 for the passage of gas under pressure, preferably air. The end plug 20 has an annular seal 28 contacting the lower end of the cylinder 12 and has a central bore 30. An L-shaped passage 32 in the plug 20 supplies return air to the chamber 16.

The separator 22 has two outer seals 34 and 36 and two inner seals 38 and 40 located in a central bore 42. An L-shaped vent passage 44 in the separator 22 communicates with the pressure chamber 14. The various components are held in assembled relationship by means of four through-bolts and nuts 48, as is known in the art.

A working piston 50 with an annular seal 52 is located within the chamber 16 and has a piston rod 54 affixed thereto and extending through the bore 30 in the end plug 20. The outer end of the piston rod can have suitable means for making a connection with an electrode (not shown) when employed for resistance welding or can have other means for making it adaptable to other operations, such as piercing, riveting, clinching, and forming.

An outer rear piston 56 in the pressure chamber 14 is made in two parts—a thick portion 58 and a thin portion 60 having an annular seal 62. The thick portion 58 has a cylindrical recess 66 therein and a bore 68 having annular seals 70 and 72. The outer rear piston 56 also has a central air supply port 74 and side L-shaped air supply passages 76 communicating with the back of the chamber 14 and with the bore 68.

An inner rear piston 78 with an annular seal 80 is located in the cylindrical recess 66 for limited travel between the end of the recess and the thinner portion 60 of the outer rear piston 56. A main piston rod 82 extends from the inner rear piston 78 through the bore 68, the bore 42 in the separator 22, and through the working piston 50 where it is suitably affixed in the piston rod 54, as by threads 84 and a tapped hole 86. The main rod 82 has a central longitudinally-extending passage 88 which terminates near the inner rear piston 78 at one end and terminates near the working piston 50 at the other end. The passage communicates with the rear air holes or openings 90 therein along with front air holes or openings 92 and a smaller front hole or opening 94 beyond the holes 92.

Figure 2:
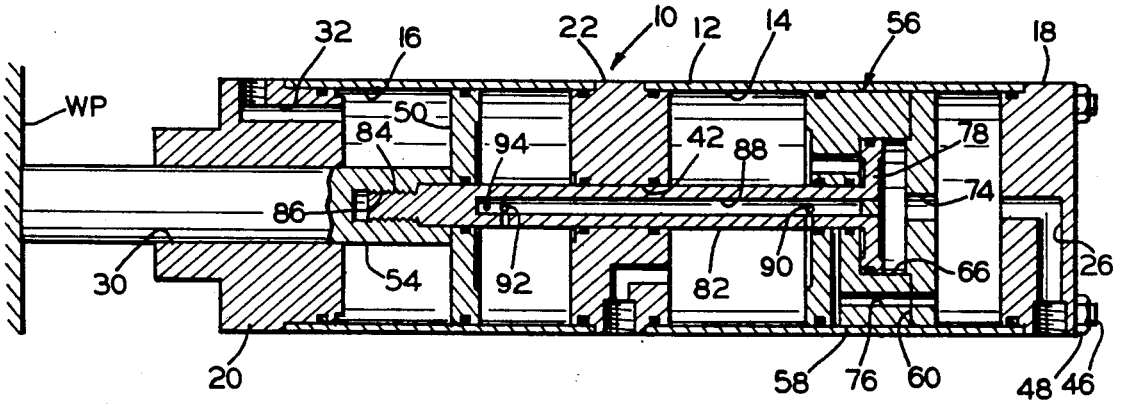
FIG. 2 is a view similar to FIG. 1 with certain components shown in different positions.

The various components are shown in their initial, at-rest positions in FIG. 1. To initiate a working cycle, pressurized air is supplied to the passage 26 in the end plug 18 and through the central port 74 in the outer piston 56. The inner rear piston 78 moves forwardly in the cylindrical recess 66 and when it reaches the end of its short stroke, the holes 90 are exposed to atmosphere through the vent 44. Shortly thereafter, the outer rear piston 56 moves forwardly, receiving pressurized air on its rear face. The inner and outer pistons move forwardly, as shown in FIG. 2. At this time, air is passed from the chamber 14 in front of the outer piston 56 through the holes 90, through the main rod passage 88, and out the holes 92 to the rear of the working piston 50. This continues until the piston rod 54 engages a workpiece WP, as shown in FIG. 2.

Figure 3:
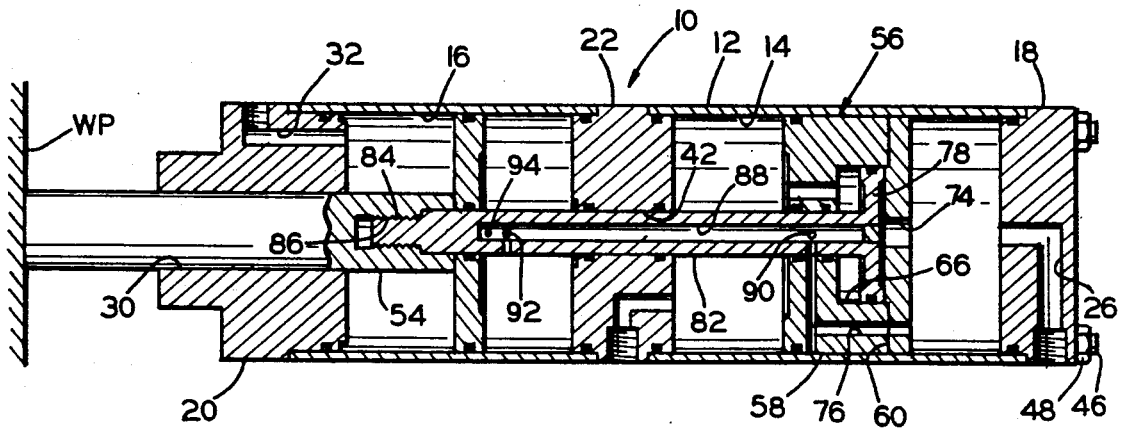
FIG. 3 is a view similar to FIG. 1 with certain components shown in still different positions.

At the moment of impact, the main rod 82 stops and the outer rear piston 56 moves forwardly on the rod (FIG. 3), causing air to pass through the L-shaped passage 76, the holes 90, the passage 88 in the rod 82, and through the openings 92, thereby pressurizing the rear face of the working piston 50. At this point, the low-impact unit produces the full force of the three pistons 50, 56, and 78 on the working piston rod 54.

On the return stroke, air under pressure is introduced to the return passage 32 and the passage 26 is vented to atmosphere through suitable valving. The front of the working piston 50 is exposed to return air under pressure and cause the inner piston 78 to move back in the cylindrical recess 66. The piston 78 then moves the outer piston 56 to the initial position (FIG. 1). During this movement, air from the rear of the working piston 50 is vented to atmosphere through the holes 92, the passage 88, the holes 90, and through the L-shaped passages 76 to the now-vented passage 26. During the last part of the return stroke of the working piston 50, air is exhausted at the rear of the working piston only through the smaller hole 94 and is restricted to act as a cushion and prevent the piston from abruptly stopping in its return position of FIG. 1.

From the above, it will be seen that the low-impact drive unit in accordance with the invention provides low-impact force of the working piston rod on the workpiece due to the multiple stage operating sequence. This eliminates the high-impact force associated with regular air cylinders, which can cause unwanted part deformation and tool wear. Since the advance of the working piston is achieved by using the force of both rear pistons, both the rate of air intake and the total volume of air used to operate the drive unit is less than that of a comparable regular double piston air cylinder.

Additionally, if during the first part of the advance stroke, more advance force is required than can be provided by the inner rear piston alone, then the working piston is automatically energized to provide more advanced force. This occurs because the additional resistance on the main rod prevents the inner rear piston from immediately shifting inside the outer rear piston, thereby providing an air path to the working piston before impact.

Various modifications of the above-described embodiment of the invention will be apparent to those skilled in the art, and it is to be understood that such modifications can be made without departing from the scope of the invention, if they are within the spirit and the tenor of the accompanying claims.

We claim:

1. A low-impact drive unit comprising wall means forming a cylinder, first plug means closing off one end of said cylinder, second plug means closing off the other end of said cylinder, intermediate separator means separating the interior of said cylinder into a pressure cylindrical chamber at said one end of said cylinder and a working cylindrical chamber at said other end of said cylinder, said first plug means having first passage means for supplying gas under pressure toward said pressure chamber, said second plug means having a first central bore therethrough, a working piston in said working chamber and having a working piston rod affixed thereto and extending through said bore, said separator means having a second central bore and vent means communicating with said pressure chamber, an outer rear piston in said pressure chamber having a cylindrical recess and a third central bore, and an inner rear piston located in said cylindrical recess and having a main rod extending through said third central bore, through said second central bore, and affixed to said working piston rod through said working piston, said main rod having a longitudinal passage, a rear hole communicating with said passage, and a front hole communicating with said passage, said outer rear piston having a central port through which gas under pressure is supplied to said cylindrical recess, said outer rear piston further having second passage means communicating with said third central bore, whereby gas under pressure is supplied through said second passage means to said rear hole, said passage, and through said front hole into said working chamber behind said working piston when said second passage means and said rear hole are aligned.

2. A drive unit according to claim 1 wherein said second passage means and said rear hole are aligned when said inner rear piston is at an outer end of said cylindrical recess.

3. A drive unit according to claim 1 wherein said separator means also has vent means communicating with said pressure chamber.

4. A drive unit according to claim 1 wherein said outer rear piston is made in two portions, one portion having said central port which communicates with said cylindrical recess in the other portion and with said first passage means in said first plug means.

5. A drive unit according to claim 1 wherein said passage has a second front hole communicating therewith located toward said first working chamber from said front hole and being smaller in size.

6. A low-impact drive unit comprising wall means forming a pressure chamber and a working chamber, separator means separating said chambers, first passage means for supplying gas under pressure to a rear portion of said pressure chamber, a working piston in said working chamber and having a working piston rod extending out of said working chamber, said separator means having a central bore and vent means communicating with said pressure chamber, an outer rear piston in said pressure chamber having a cylindrical recess and a second central bore therein, an inner rear piston located in said cylindrical recess and having a main rod extending through said bores and movable with said working piston rod, said main rod having a longitudinal passage, a rear hole communicating with said passage, and a front hole communicating with said passage, said outer rear piston having a central port through which gas under pressure is supplied to said cylindrical recess from said first passage means, said outer rear piston having second passage means communicating with said second central bore, whereby gas under pressure is supplied through said main rod to said working chamber behind said working piston when said second passage means and said rear hole are aligned.

7. A drive unit according to claim 6 wherein said second passage means and said rear hole are aligned when said inner piston is at an outer end of said cylindrical recess.

8. A drive unit according to claim 6 wherein said rear hole communicates with said pressure chamber in front of said outer rear piston when said inner rear piston is at the bottom end of said cylindrical recess, whereby gas is supplied through said rear hole and said front hole to said working chamber behind said working piston as said outer and inner rear pistons move toward said working chamber together when gas under pressure is supplied through said first passage means.

9. A drive unit according to claim 6 wherein said outer rear piston is made in two portions, one portion having said central port which communicates with said cylindrical recess in the other portion and with said first passage means in said first plug means.

10. A drive unit according to claim 6 wherein said passage has a second front hole communicating therewith located toward said first working chamber from said front hole and being smaller in size.

11. A drive unit according to claim 6 wherein third passage means are provided for supplying return air to said working chamber in front of said working piston.

12. A low-impact drive unit comprising wall means forming a pressure chamber and an annular working chamber, separator means separating said chambers, first passage means for supplying gas under pressure to a rear portion of said pressure chamber, a working piston in said working chamber and having a working piston rod extending out of said working chamber, said separator means having a central bore, an outer rear piston in said pressure chamber having a cylindrical recess and a second central bore therein, an inner rear piston located in said cylindrical recess and having a main rod extending through said bores and movable with said working piston rod, said main rod having a longitudinal passage, a rear hole communicating with said passage, and a front hole communicating with said passage, said outer rear piston having a central port through which gas under pressure is supplied to said cylindrical recess from said first passage means, and said outer rear piston having second passage means communicating with said second central bore.

13. A drive unit according to claim 12 wherein said separator means also has vent means communicating with said pressure chamber.

14. A drive unit according to claim 12 wherein said second passage means and said rear hole are aligned when said inner piston is at an outer end of said cylindrical recess.

15. A drive unit according to claim 12 wherein said rear hole communicates with said pressure chamber in front of said outer rear piston when said inner rear piston is at the bottom end of said cylindrical recess, whereby gas is supplied through said rear hole and said front hole to said working chamber behind said working piston as said outer and inner rear pistons move toward said working chamber together when gas under pressure is supplied through said first passage means.

16. A drive unit according to claim 12 wherein said outer rear piston is made in two portions, one portion having said central port which communicates with said cylindrical recess in the other portion and with said first passage means in said first plug means.

17. A drive unit according to claim 12 wherein said passage has a second front hole communicating therewith located toward said first working chamber from said front hole and being smaller in size.

18. A drive unit according to claim 12 wherein said main rod extends through said working piston and has a threaded end received in a tapped bore in said working piston rod.

19. A drive unit according to claim 12 wherein third passage means are provided for supplying return air to said working chamber in front of said working piston.

* * * * *